US007686677B2

(12) United States Patent
Peterson

(10) Patent No.: US 7,686,677 B2
(45) Date of Patent: Mar. 30, 2010

(54) FLOOR TREATMENT MACHINE WITH WHEEL ASSEMBLY

(75) Inventor: Clayton Peterson, Laguna Woods, CA (US)

(73) Assignee: Pearl Abrasive Company, Commerce, CA (US)

( * ) Notice: Subject to any disclaimer, the term of this patent is extended or adjusted under 35 U.S.C. 154(b) by 252 days.

(21) Appl. No.: 11/239,780

(22) Filed: Sep. 29, 2005

(65) Prior Publication Data

US 2007/0094821 A1 May 3, 2007

(51) Int. Cl.

| | |
|---|---|
| ***B24B 23/00*** | (2006.01) |
| ***B24B 27/08*** | (2006.01) |
| ***A47L 11/00*** | (2006.01) |
| ***A47L 7/00*** | (2006.01) |
| *A47L 11/02* | (2006.01) |

(52) U.S. Cl. ..... 451/353; 15/49.1; 15/320

(58) Field of Classification Search ..... 451/353; 15/49.1, 320, 50.1

See application file for complete search history.

(56) References Cited

U.S. PATENT DOCUMENTS

| | | | | | |
|---|---|---|---|---|---|
| 3,867,796 | A * | 2/1975 | Sonnenberg | 451/352 |
| 4,739,534 | A * | 4/1988 | Wilson | 15/230.16 |
| 5,129,708 | A * | 7/1992 | Swan | 299/41.1 |
| 5,416,943 | A * | 5/1995 | Weltikol et al. | 15/49.1 |
| 5,477,578 | A * | 12/1995 | Duncan et al. | 15/49.1 |
| 5,548,860 | A * | 8/1996 | Weltikol et al. | 15/50.1 |
| 5,575,710 | A * | 11/1996 | Kramer | 451/350 |
| 5,607,178 | A * | 3/1997 | Legatt et al. | 15/320 |
| 6,088,873 | A * | 7/2000 | Pacchini et al. | 15/320 |
| 6,238,277 | B1 * | 5/2001 | Duncan et al. | 451/271 |
| 6,353,957 | B1 * | 3/2002 | Wolfe et al. | 15/49.1 |
| 6,419,565 | B2 * | 7/2002 | Mattson et al. | 451/59 |
| 6,578,858 | B1 * | 6/2003 | Haddock | 280/47.131 |
| 6,971,137 | B2 * | 12/2005 | Pierce et al. | 15/49.1 |
| 6,986,397 | B2 * | 1/2006 | Mattson et al. | 180/11 |
| 7,076,825 | B2 * | 7/2006 | Fellhauer | 15/49.1 |
| 2003/0192573 | A1 * | 10/2003 | Tran | 134/6 |
| 2004/0045108 | A1 * | 3/2004 | Fellhauer | 15/49.1 |
| 2005/0246845 | A1 * | 11/2005 | Duncan et al. | 15/49.1 |

OTHER PUBLICATIONS

National Flooring Equipment, Floor Prep/Removal/Grinders/Buffers, Single Disc Floor Prep System 220V, http://www.nationalequipment.com/itemdesc.asp?item=6274-W&ref=bcat &catid=D44I66EE-59..., 1 page.

(Continued)

*Primary Examiner*—Alvin J. Grant
(74) *Attorney, Agent, or Firm*—Sheppard Mullin Richter & Hampton, LLP

(57) ABSTRACT

A wheel assembly for a floor treatment machine is provided that aids the operator in maintaining positive control of the machine. The wheel assembly includes a body that can be removably attached to the floor treatment machine, and wheels that are configured to contact the floor, while the floor treatment machine is in use. The body of the wheel assembly can include a first end disposed below the base of the floor treatment machine, an intermediate region, and a second end extending beyond the base.

15 Claims, 5 Drawing Sheets

OTHER PUBLICATIONS

National Flooring Equipment, Floor Prep/Removal/Grinders/Buffers, 1-1/2 HP Buffer 120V R52-3, http://www.nationalequipment.com/itemdesc.asp?item 6015&ref bcat&catid D44166EE-59A1-..., 1 page.

National Flooring Equipment, Floor Prep/Removal/Grinders/Buffers, SQL Head Grinder**R37-2, http://www.nationalequipment.com/itemdesc.asp?item=6274&ref=bcat&catid=D44166EE-59A1-..., 1 page.

* cited by examiner

FLOOR TREATMENT MACHINE WITH WHEEL ASSEMBLY

BACKGROUND OF THE INVENTION

The invention relates generally to floor treatment machines and, more particularly, to attachments for floor treatment machines.

Floor treatment machines are commonly used for polishing, grinding, sanding or otherwise treating surfaces such as concrete or wood floors. Typically, such floor treatment machines have a handle and a housing that contains a motor for rotating a floor treatment head. Such machines also typically include transport wheels disposed between housing and the handle. The wheels serve as a fulcrum, allowing the user to raise the housing for transport by pressing down on the handle. The wheels are offset and elevated relative to the treatment head so that they do not contact the floor. This enables the user to move the machine in any desired direction while in use, which can be particularly beneficial in various applications, such as sanding, grinding and polishing floors.

In use, the head of the machine rotates on the floor surface that is being treated, and the user guides machine about floor with the handle. The head of the machine rotates at a high rate, imparting substantial torque. Accordingly, the user must maintain active control of the machine throughout its operation. This can be particularly challenging for novice users and, if not careful, even experienced users can lose control of the machine. Any loss of control creates a serious risk of injury.

It should, therefore, be appreciated that there remains a need for a system that addresses these risks. The present invention fulfills this and other needs.

SUMMARY OF THE INVENTION

Briefly, and in general terms, the invention provides a wheel assembly for a floor treatment machine that aids the operator in maintaining positive control of the machine. The wheel assembly includes a body that can be removably attached to the floor treatment machine and wheels that are configured to contact the floor, while the floor treatment machine is in use.

More specifically, and in an exemplary embodiment, the body of the wheel assembly includes a first end disposed below the base of the floor treatment machine, an intermediate region, and a second end extending beyond the base.

In a detailed aspect of an exemplary embodiment, the first end of the base includes laterally extending portions that extend beyond the sides of the base, the intermediate region having a width less than a width of the first end, and the second end having a width greater than the width of the intermediate region. The wheels are coupled to the second end of the body.

In another detailed aspect of an exemplary embodiment, the wheel assembly includes a plurality of attachment mechanisms configured to extend over a base of the floor treatment machine to removably attach the wheel assembly to the floor treatment machine.

In yet another detailed aspect of an exemplary embodiment, the wheel assembly includes a bridge extending over the base of the floor treatment machine and having two ends attached to the first end of the body on opposing sides thereof.

Embodiments of the wheel assembly can be particularly effective with floor treatment machines designed to abrade or otherwise remove material from the surface being treated. The wheel assembly allows the operator to maintain positive control of the floor treatment machine, even while working difficult surfaces. For example, in abrading hard surfaces such as concrete, floor treatment machines can be difficult to control. The wheel assembly aids in maintaining control and allows the operator to remove material more effectively.

For purposes of summarizing the invention and distinguishing it over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings, in which.

DETAILED DESCRIPTION OF THE PREFERRED EMBODIMENTS

Figure 1:
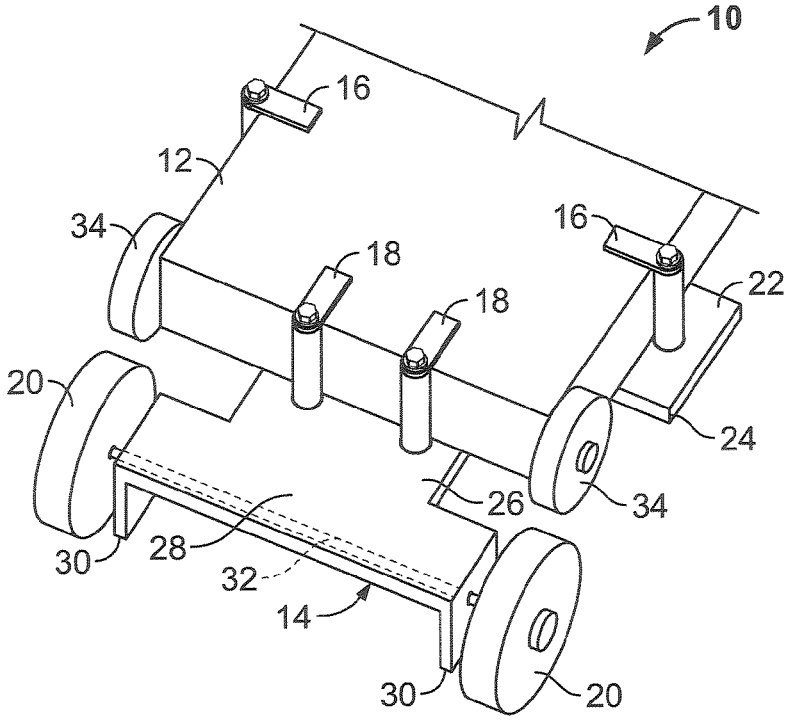
FIG. 1 is a perspective view of a first embodiment of a wheel assembly attached to a floor treatment machine in accordance with the invention.

With reference to the drawings, and particularly FIG. 1, there is shown a wheel assembly 10 attached to a base 12 of a floor treatment machine. The wheel assembly includes a body 14 positioned below the base and held in place by several attachment mechanisms 16, 18. Wheels 20 are coupled to the body in such manner as to maintain contact with the floor while the floor treatment machine is in use. To that end, the wheels are generally on plane with the contact surface of the machine's floor treatment head (not shown). In this manner, the wheel assembly aids the operator in maintaining positive control of the machine while in use.

The base 12 of the wheel assembly 10 has a first end 22 that includes laterally extending portions 24 that extend beyond the sides of the base 12 of a floor treatment machine. These portions are conveniently located so that two of the attachment mechanisms 16 can extend over the base along respective sides thereof. Two additional attachment mechanisms 18 are located in an intermediate region 26 of the body and extend over an end of the base. The attachment mechanisms are configured to clamp the wheel assembly securely and removably to the floor treatment machine. Shims can be positioned between the base and the wheel assembly, if needed, to facilitate a snug fit. In other embodiments, various other attachment arrangements can be used to secure the wheel assembly to the floor treatment machine.

The base 12 further includes a second end 28 that includes downward projections 30 for supporting the axle. The wheels 20 of the wheel assembly 10 are positioned to provide stability to the floor treatment machine. The wheels are attached to a single axle 32 that extends through apertures of the second end. The wheelbase is substantially wider than transport wheels 34 of the floor treatment machine. In other embodiments, positioning of the wheels can vary to conform to particular floor treatment machines, as desired.

Figure 2:
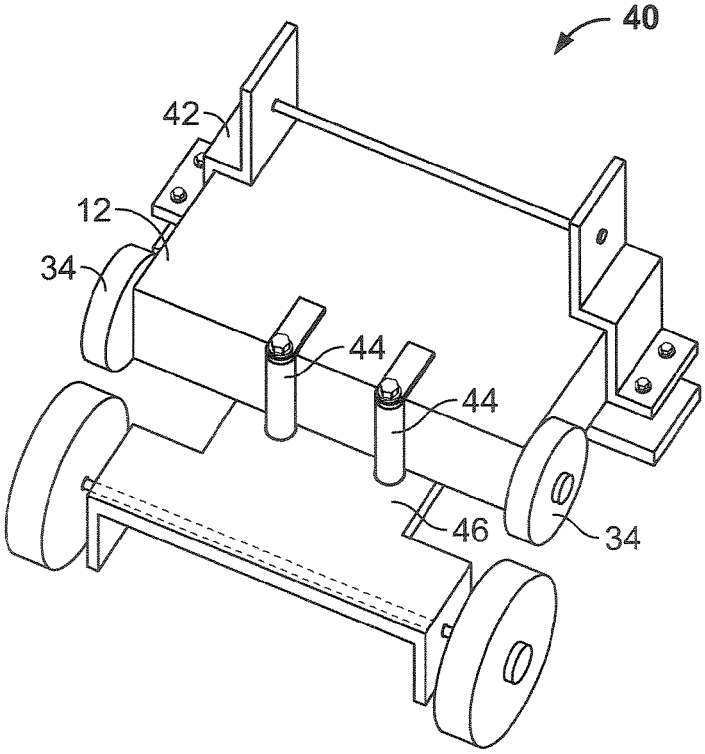
FIG. 2 is a perspective view of a second embodiment of a wheel assembly attached to a floor treatment machine in accordance with the invention.

With reference now to FIG. 2, a second embodiment, wheel assembly 40 is depicted. This embodiment is similar to the first embodiment. However, rather than two separate attachment mechanisms at the first end, the wheel assembly includes a single attachment mechanism, a bridge 42, that extends over the base of the floor treatment machine and attaches to the first end of the base. The wheel assembly 40 further includes two clamps, 44 that extend from an intermediate region 46 of the body over an end of the base.

Figure 3:
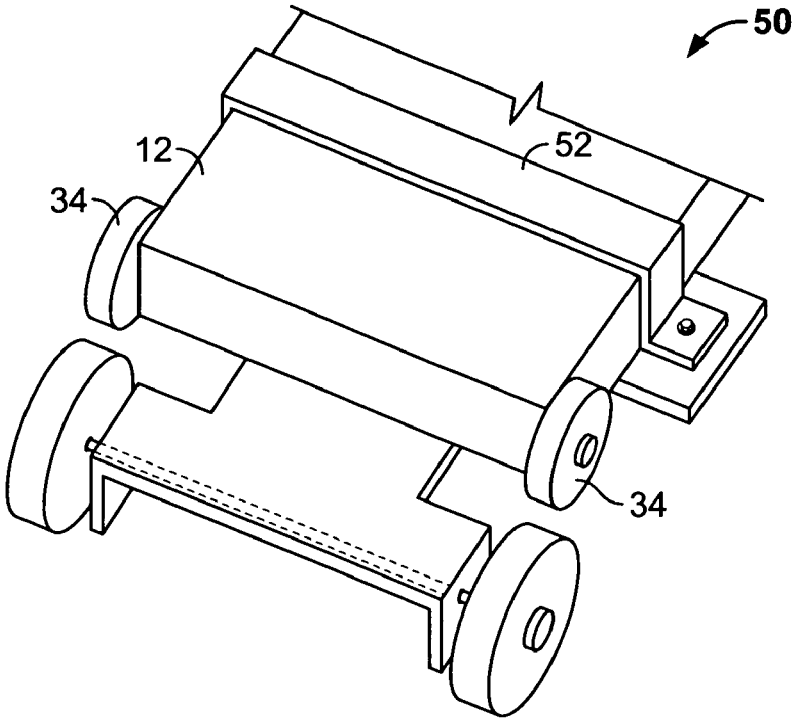
FIG. 3 is a perspective view of a third embodiment of a wheel assembly attached to a floor treatment machine in accordance with the invention.
Figure 4:
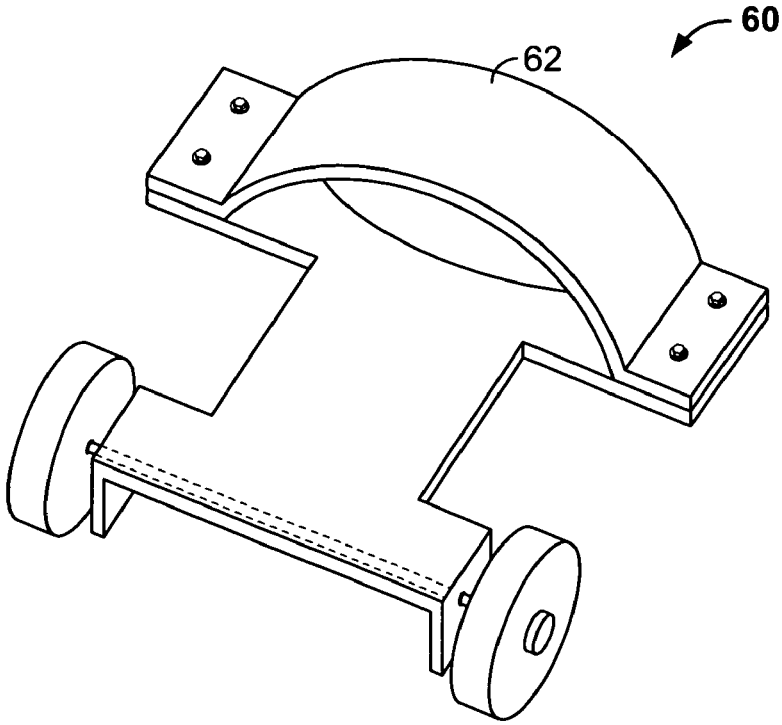
FIG. 4 is a perspective view of a fourth embodiment of a wheel assembly attached to a floor treatment machine in accordance with the invention.

Referring to FIGS. 3 and 4, third and fourth embodiments, wheel assemblies 50 and 60, respectively, are shown. Both of these embodiments incorporate a bridge that couples the wheel assembly to the base of the floor treatment machine. Various shapes can be provided for the bridge to ensure a secure attachment to the base, and the bridges can be configured to enable the wheel assembly to conform to height variations among different models of floor treatment machines, as well as among different types of floor treatment heads.

In FIG. 3, the wheel assembly 50 includes a bridge 52 of a unitary piece of metal formed with right angles. In FIG. 4, the wheel assembly 60 includes a bridge 62 of a unitary piece of metal having a central arch. The shape of the bridge is currently configured to mate with various floor treatment machines commercially available. Wheel assemblies 50, 60 exclude attachment mechanisms that extend from the intermediate region over the end of the base; however, in other embodiments, such attachment mechanisms can be included.

Referring now to FIGS. 5-8, a fifth embodiment, wheel assembly 80, is shown. The wheel assembly 80 includes a body 82 configured to be positioned below a base 84 of a floor treatment machine 86 and held in place by attachment mechanisms, two c-shaped hooks 88 and a clamp 90. The c-shaped hooks define a recess 92 for receiving an axle 94 of the floor treatment machine. The clamp is removably secured to an intermediate region 96 of the body and extends over an end 98 of the base 84.

Figure 5:
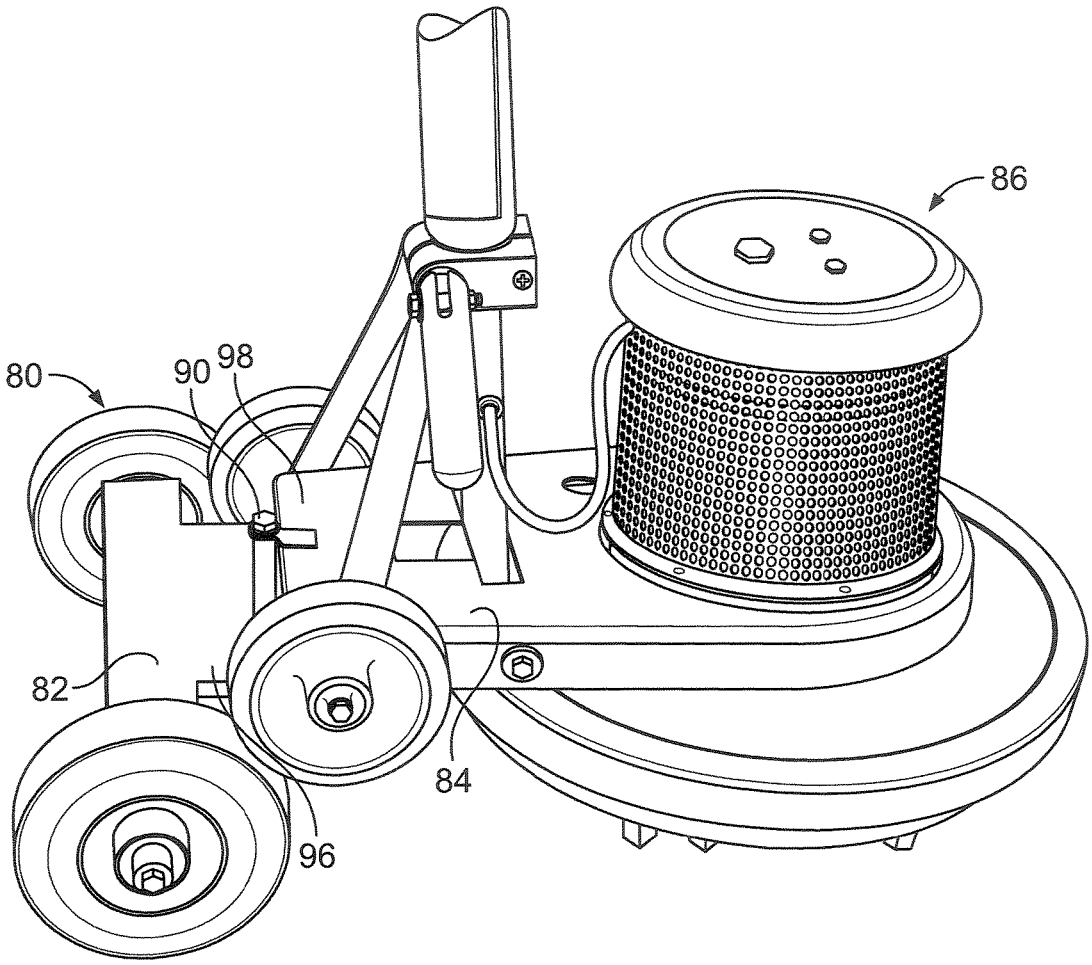
FIG. 5 is a perspective view of a fifth embodiment of a wheel assembly in accordance with the invention, depicting the wheel assembly attached to a floor treatment machine.

As best seen in FIG. 5, the wheel assembly is coupled to the body in such manner as to maintain contact with the floor while the floor treatment machine is in use. To that end, the wheels are generally on plane with the contact surface of the machine's floor treatment head. In other embodiments, the wheel positioning relative to the contact surface can be varied to accommodate other operational needs.

Figure 6:
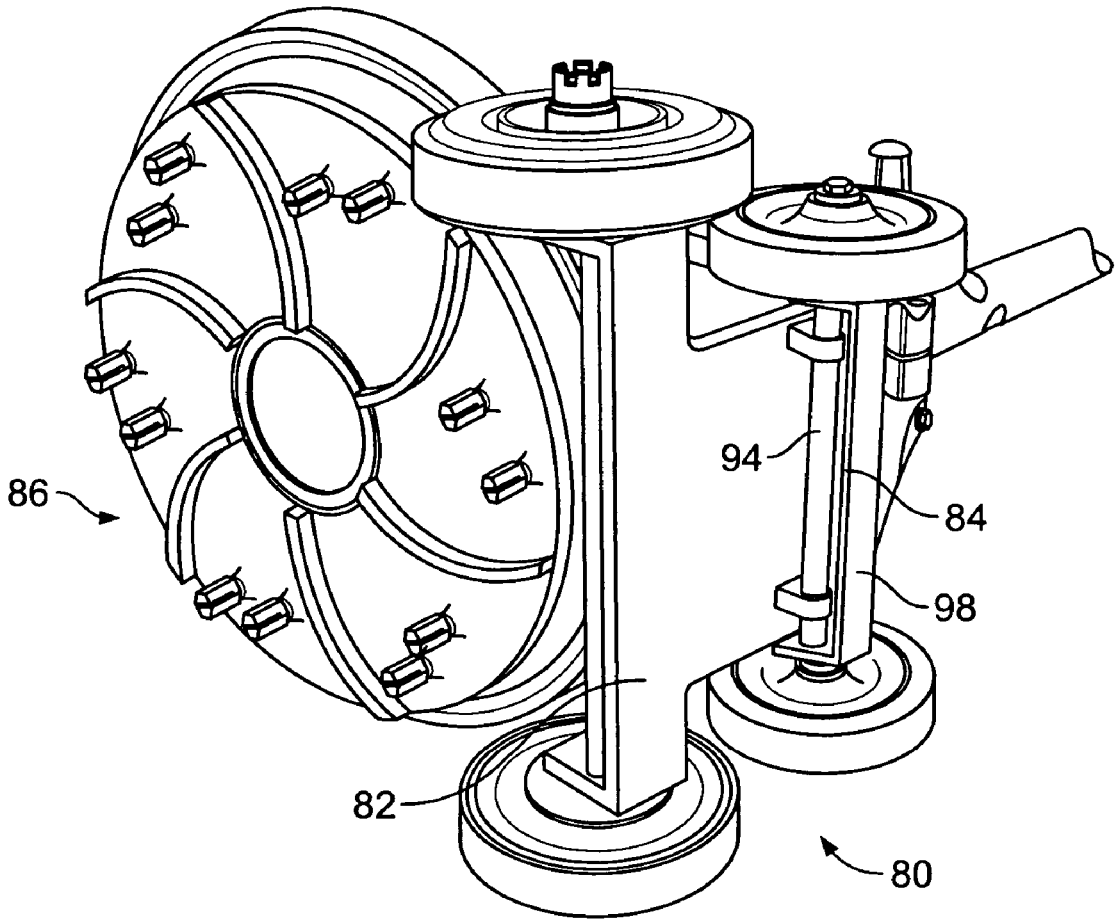
FIG. 6 is a perspective view of the wheel assembly of FIG. 5, depicting the wheel assembly being mounted to the floor treatment machine.
Figure 7:
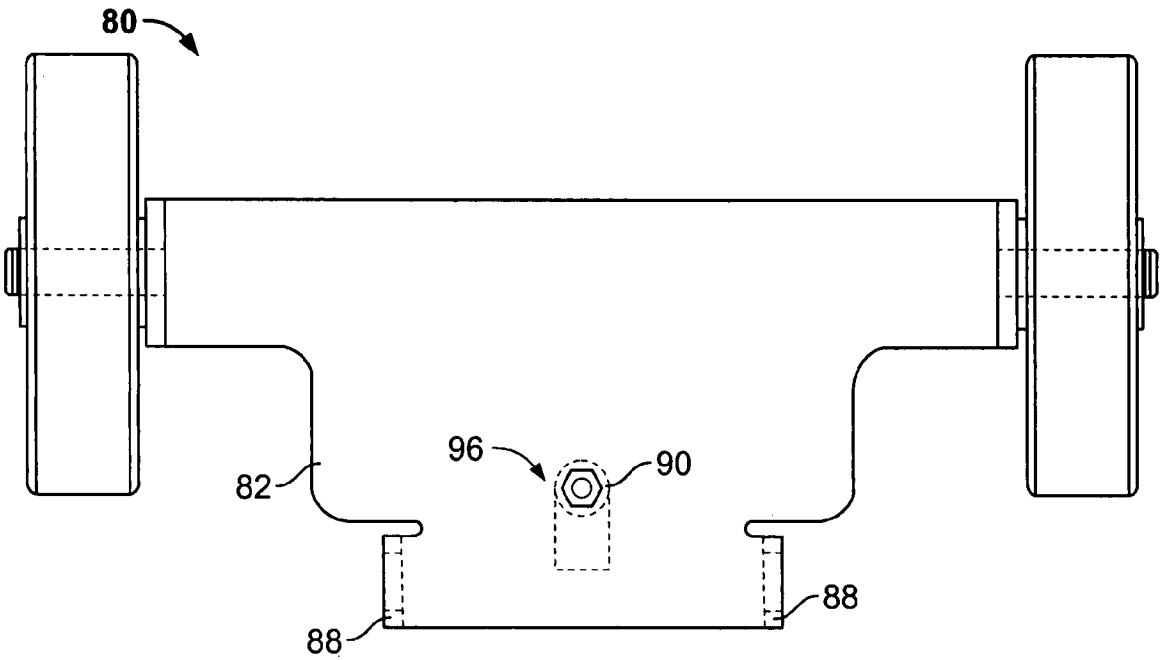
FIG. 7 is a top plan view of the wheel assembly of FIG. 5.
Figure 8:
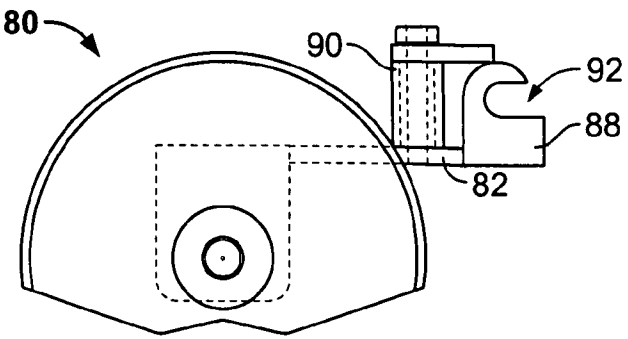
FIG. 8 is a side elevational view of the wheel assembly of FIG. 5.

As shown in FIG. 6, the wheel assembly 80 can be quickly attached to the floor treatment machine 86. To do so, the floor treatment machine is oriented on its side so that the c-shaped hooks of the wheel assembly can engage the axle 102 of the floor treatment machine. Next, the wheel assembly is rotated about the axle so that its body is generally aligned with the base 84. Once aligned, the clamp 90 is attached to the intermediate region of the body.

Embodiments of the wheel assembly can be particularly effective with floor treatment machines designed to abrade or otherwise remove material from the surface being treated. The wheel assembly allows the operator to maintain positive control of floor treatment machine, even while working difficult surfaces. For example, in abrading hard surfaces such as concrete, floor treatment machines can be difficult to control. The wheel assembly aids in maintaining control and allows the operator to remove material more effectively.

In each of the exemplary embodiments depicted in the figures, the body of the wheel assembly is formed of steel-.However, in various other embodiments, other materials having sufficient durability can be used.

It should be appreciated from the foregoing that the present invention provides a wheel assembly configured to mate with various floor treatment machines to provide stable support during use. The wheel assembly includes a body that can be removably attached to the floor treatment machine and wheels that are configured to contact the floor, while the floor treatment machine is in use. The body of the wheel assembly can include a first end disposed below the base of the floor treatment machine, an intermediate region, and a second end extending beyond the base. Various approaches for attaching the wheel assembly can be used. For example, the wheel assembly can include a plurality of attachment mechanisms configured to extend over a base of the floor treatment machine.

Although the invention has been disclosed in detail with reference only to the exemplary embodiments, those skilled in the art will appreciate that various other embodiments can be provided without departing from the scope of the invention. Accordingly, the invention is defined only by the claims set forth below.

What is claimed is:

1. A floor treatment machine comprising:

a housing that contains a motor for rotating a floor treatment head;

a direct coupling between the motor and the floor treatment head;

a handle extending from the housing;

transport wheels disposed between the housing and the handle, wherein in normal use to treat a floor, the machine's treatment head directly engages the floor while the transport wheels are spaced from the floor, and a wheel assembly comprising:

a body;

supplemental wheels coupled to the body; and a coupler coupled to the body and configured to attach to a floor treatment machine without disrupting the direct coupling between the motor and the floor treatment head, such that the supplemental wheels contact the floor and provide rigid support to the floor treatment machine while the floor treatment machine is in use, with its treatment head engaging the floor.

2. A floor treatment machine as defined in claim 1, wherein the body includes a first end disposed below the base of the floor treatment machine, an intermediate region, and a second end extending beyond the base.

3. A floor treatment machine as defined in claim 2, wherein the first end of the base includes laterally extending portions that extend beyond the sides of the base, the intermediate region having a width less than a width of the first end, and the second end having a width greater than the width of the intermediate region.

4. A floor treatment machine as defined in claim 3, wherein the supplemental wheels are coupled to the second end of the body.

5. A floor treatment machine as defined in claim 4, wherein an axle extends between the supplemental wheels.

6. A floor treatment machine as defined in claim 1, wherein the coupler includes a plurality of attachment mechanisms configured to extend over the base of the floor treatment machine.

7. A floor treatment machine as defined in claim 1, wherein the coupler includes a bridge extending over the base of the floor treatment machine and having two ends attached to the first end of the body on opposing sides thereof.

8. A floor treatment machine comprising:

a housing that contains a motor for rotating a floor treatment head;

a direct coupling between the motor and the floor treatment head;

a handle extending from the housing;

transport wheels disposed between the housing and the handle, wherein in normal use to treat a floor, the machine's treatment head directly engages the floor while the transport wheels are spaced from the floor, and a wheel assembly comprising:

a body having a first end configured to be disposed below a base of a floor treatment machine, an intermediate region, and a second end configured to extend beyond the base;

supplemental wheels coupled to the body; and a coupler coupled to the body and configured to attach to the floor treatment machine without disrupting the direct coupling between the motor and the floor treatment head, such that the supplemental wheels contact the floor and provide rigid support to the floor treatment machine while the floor treatment machine is in use, with its treatment head engaging the floor.

9. A floor treatment machine as defined in claim 8, wherein the supplemental wheels are coupled to the second end of the body.

10. A floor treatment machine as defined in claim 9, wherein an axle extends between the supplemental wheels.

11. A floor treatment machine as defined in claim 8, wherein the coupler includes a plurality of attachment mechanisms configured to extend over the base of the floor treatment machine.

12. A floor treatment machine as defined in claim 8, wherein the coupler includes a bridge extending over the base of the floor treatment machine and having two ends attached to the first end of the body on opposing sides thereof.

13. A floor treatment machine comprising:

a housing that contains a motor for rotating a floor treatment head;

a direct coupling between the motor and the floor treatment head;

a handle extending from the housing;

transport wheels disposed between the housing and the handle, wherein in normal use to treat a floor, the machine's treatment head directly engages the floor while the transport wheels are spaced from the floor, and a wheel assembly comprising:

a body having a first end configured to be disposed below a base of a floor treatment machine, an intermediate region, and a second end configured to extend beyond the base;

supplemental wheels attached to an axle and coupled to the body; and a coupler coupled to the body and configured to attach to the floor treatment machine without disrupting the direct coupling between the motor and the floor treatment head, such that the supplemental wheels contact the floor and provide rigid support to the floor treatment machine while the floor treatment machine is in use, with its treatment head engaging the floor; wherein the first end of the base includes laterally extending portions that extend beyond the sides of the base, the intermediate region having a width less than a width of the first end, and the second end having a width greater than the width of the intermediate region.

14. A floor treatment machine as defined in claim 13, wherein the coupler includes a plurality of attachment mechanisms configured to extend over the base of the floor treatment machine.

15. A floor treatment machine as defined in claim 13, wherein the coupler includes a bridge extending over the base of the floor treatment machine and having two ends attached to the first end of the body on opposing sides thereof.

* * * * *